US011951346B1

(12) United States Patent
Pierce

(10) Patent No.: US 11,951,346 B1
(45) Date of Patent: Apr. 9, 2024

(54) PORTABLE EXERCISE DEVICE

(71) Applicant: Tony Pierce, Evanston, WY (US)

(72) Inventor: Tony Pierce, Evanston, WY (US)

( * ) Notice: Subject to any disclaimer, the term of this patent is extended or adjusted under 35 U.S.C. 154(b) by 151 days.

(21) Appl. No.: 17/729,157

(22) Filed: Apr. 26, 2022

(51) Int. Cl.

| | |
|---|---|
| ***B63B 21/04*** | (2006.01) |
| ***A63B 21/00*** | (2006.01) |
| ***A63B 21/02*** | (2006.01) |
| ***A63B 21/04*** | (2006.01) |
| ***A63B 21/16*** | (2006.01) |
| ***B63B 21/00*** | (2006.01) |
| ***B63B 21/02*** | (2006.01) |
| ***B63B 21/16*** | (2006.01) |

(52) U.S. Cl.
CPC .... *A63B 21/0442* (2013.01); *A63B 21/00069* (2013.01); *A63B 21/023* (2013.01); *A63B 21/1609* (2015.10); *A63B 21/4043* (2015.10); *A63B 2208/0233* (2013.01); *A63B 2210/02* (2013.01)

(58) Field of Classification Search
CPC ..... A63B 21/0442; A63B 21/00069; A63B 21/023; A63B 21/1609; A63B 21/4043; A63B 2208/0233; A63B 2210/02
See application file for complete search history.

(56) References Cited

U.S. PATENT DOCUMENTS

| | | | | |
|---|---|---|---|---|
| 4,944,511 | A * | 7/1990 | Francis | A63B 21/153 482/123 |
| 6,315,701 | B1 * | 11/2001 | Shifferaw | A63B 21/00069 482/110 |
| 8,075,453 | B1 * | 12/2011 | Wilkinson | A63B 21/4019 482/8 |
| 8,523,745 | B1 * | 9/2013 | Ihli | A63B 21/4019 482/114 |
| 2014/0005009 | A1 * | 1/2014 | Giannelli | A63B 21/4045 482/102 |

FOREIGN PATENT DOCUMENTS

| | | | | |
|---|---|---|---|---|
| WO | WO-2005044389 | A2 * | 5/2005 | A63B 21/055 |

* cited by examiner

*Primary Examiner* — Andrew S Lo
*Assistant Examiner* — Andrew M Kobylarz

(57) ABSTRACT

The portable exercise device includes a housing, a rotating spool, a plurality of cables, a plurality of handles, at least one securing strap, and a tensioning knob. The device is temporarily installed about the front surface of the seat back via a single or plurality of straps. The tensioning knob provides varying levels of resistance with the rotating spool. The rotating spool has a spiral coil spring that places a rotational biasing force upon the spool such that the cables will wind upon the rotating spool.

7 Claims, 7 Drawing Sheets

PORTABLE EXERCISE DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of exercise devices, more specifically, a resistance exercise device that can be used while in a seat.

People who drive long distances on a fairly frequent basis do not have much of an opportunity to stop and exercise with a resistance exercise machine. The present invention seeks to overcome this shortcoming by creating an exercise machine that can be mounted onto a vehicle seat or any seat for that matter, and enable an occupant of the vehicle an opportunity to exercise his or her a plurality of muscle groups.

B. Discussion of the Prior Art

As a preliminary note, it should be stated that there is an ample amount of prior art that deals with resistance exercise machines. As will be discussed immediately below, no prior art discloses a portable resistance exercise device that can mount to the back of a seat, which enables an occupant to exercise while seated.

The Wilkinson Patent (U.S. Pat. No. 5,324,243) discloses a portable exercise device that uses resistance bands with handles attached so the device can be placed on the back of a chair or other stationary place. However, the resistance means consists of a cord, pulley, and friction brake involves a rotatable hub that rotates vertically and extends just above the headrest of the chair as opposed to a rotating spool that rotates horizontally from within the housing. Furthermore, the housing rests between the end user and the seat back.

The Dunn Patent (U.S. Pat. No. 6,183,403) discloses a vehicle exercise system that uses a resistance cable with a handle and that is attached to some place on the vehicle. However, the exercise system does not involve a rotating spool, cable, and pulley that rotates within the housing secured to the seat back and located between the end user and the seat back.

The Willis Patent (U.S. Pat. No. 5,743,838) discloses a resistance cable exercising system that is attached to a chair and that allows a person to work their upper body while in the seat position. However, the system uses elastic members for the resistance means as opposed to a rotating spool, cable, and pulley that rotates within the housing secured to the seat back and located between the end user and the seat back.

The Barrett Patent (U.S. Pat. No. 6,110,081) discloses a portable exercise machine that is a board, with handles on each side that are connected to elastic cables that provide resistance training. Again, the machine uses elastic cables as opposed to a rotating spool, cable, and pulley that create resistance through the use of a tensioning knob.

The Whipple Patent (U.S. Pat. No. 6,093,136) discloses an exercise apparatus that is a portable device with an elastic cable and rotating resistance pulley having handles attached to the end of the cables. However, the apparatus uses elastic cables that rotate around a pulley that can lock in various intervals so that varying lengths of the elastic cable can be allotted for varying exercises. Furthermore, the container is not capable of securing itself to the seat back of a chair, but rather requires the end user sit upon stand upon, lay upon, or rest upon the container.

While the above-described devices fulfill their respective and particular objects and requirements, they do not describe a portable exercise device that uses a rotating spool, cable, and pulley that rotates within the housing secured to the seat back and located between the end user and the seat back. In this regard, the portable exercise device departs from the conventional concepts and designs of the prior art.

SUMMARY OF THE INVENTION

The portable exercise device includes the housing, a plurality of rotating spools, a plurality of cables, a plurality of handles, at least one securing strap, and a tensioning knob. The device is temporarily installed about the front surface of the seat back via a single or plurality of straps. The tensioning knob provides varying levels of resistance with the rotating spool. The rotating spool has a spiral coil spring that places a rotational biasing force upon the spool such that the cables will wind upon the rotating spool.

An object of the invention is to provide a portable exercise device that mounts to the front surface of a seat back, and can be used as a workout device while seated in the chair.

A further object of the invention is to provide a portable exercise device that provides varying levels of resistance.

A further object of the invention is to provide a portable exercise system that is simple, effective, easy-to-use, and affordable.

These together with additional objects, features and advantages of the portable exercise device will be readily apparent to those of ordinary skill in the art upon reading the following detailed description of presently preferred, but nonetheless illustrative, embodiments of the portable exercise device when taken in conjunction with the accompanying drawings.

In this respect, before explaining the current embodiments of the portable exercise device in detail, it is to be understood that the portable exercise device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable exercise device.

It is therefore important that the claims be regarded as including such equivalent construction insofar as they do not depart from the spirit and scope of the portable exercise device. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention: In the drawings.

DETAILED DESCRIPTION OF THE EMBODIMENT

Figure 1:
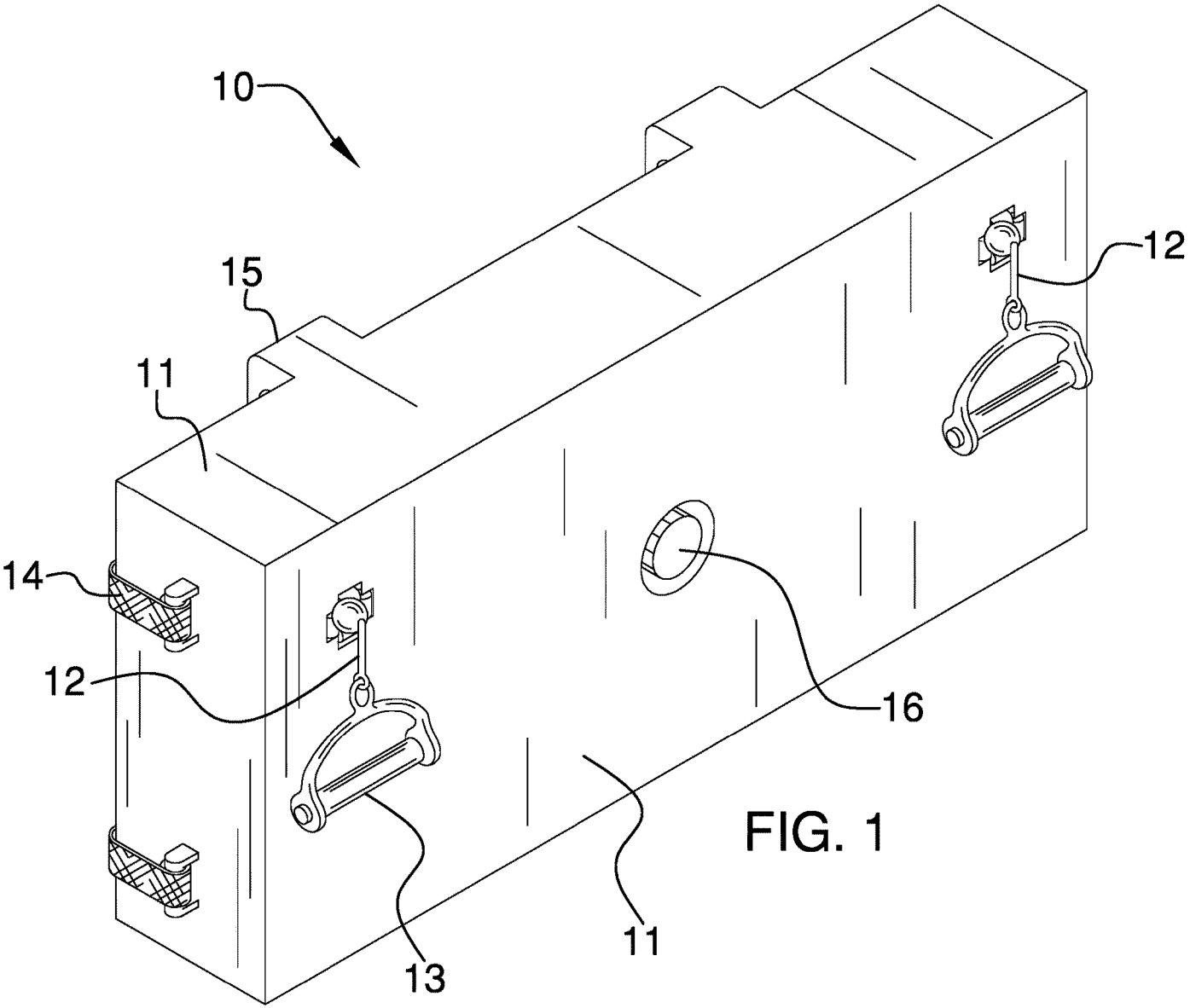
FIG. 1 illustrates a front, isometric view of the invention by itself.
Figure 2:
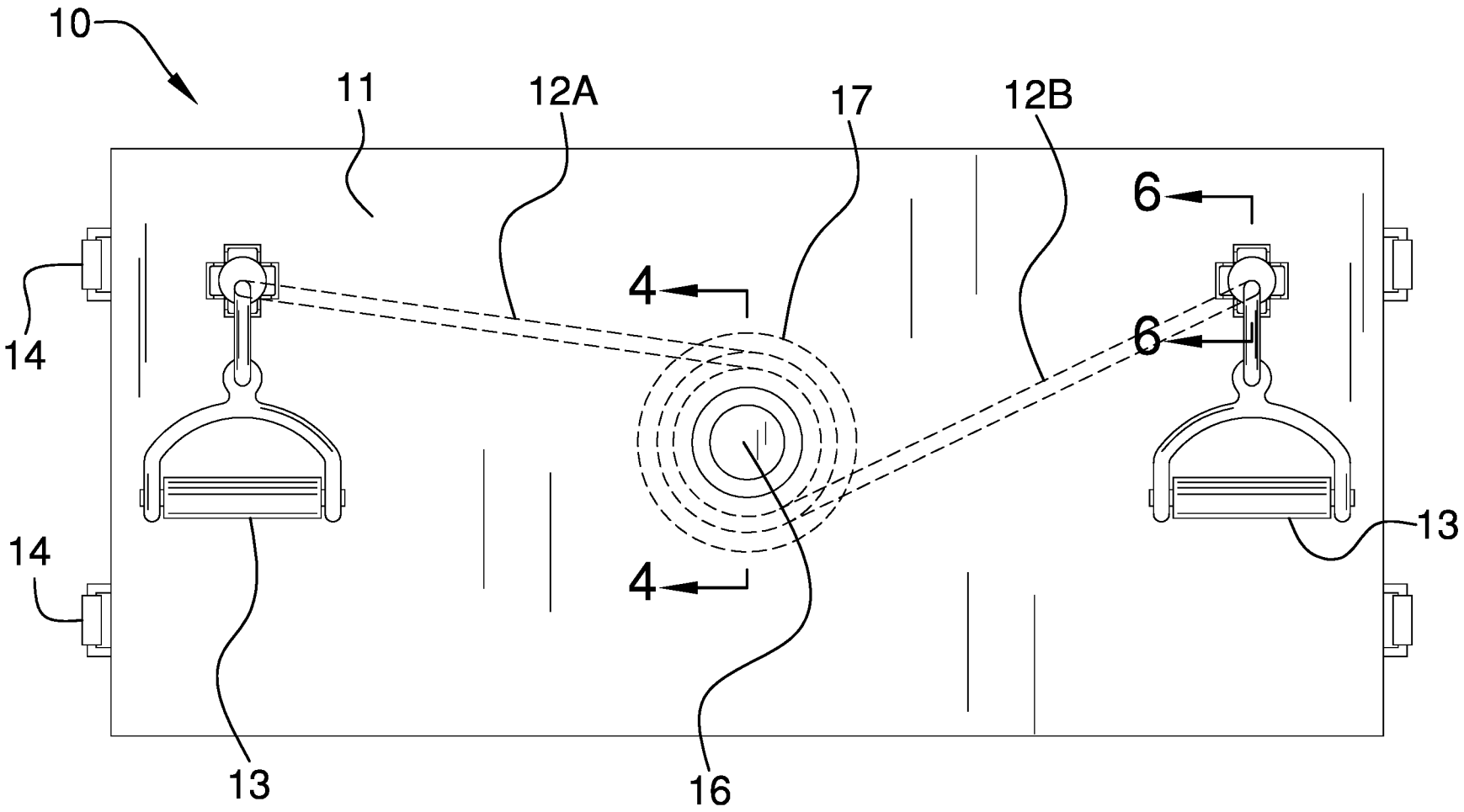
FIG. 2 illustrates a front view of the invention with hidden lines indicating the location of the rotational spool as ell as the portion of the cables remaining within the housing.
Figure 3:
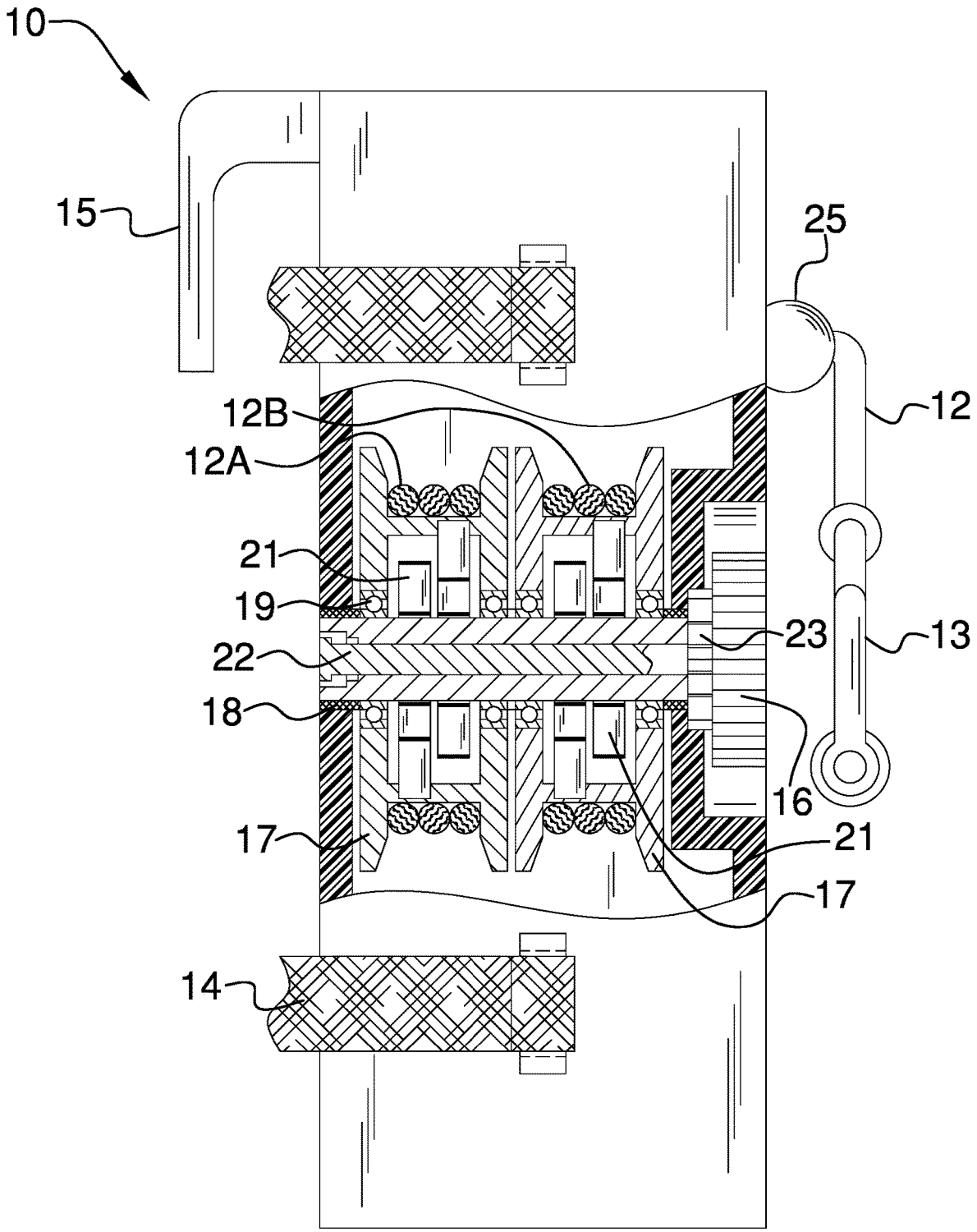
FIG. 3 illustrates a cut-away side view of the invention detailing the cross-sectional view of the rotating spool along line 4-4 in FIG. 2.
Figure 4:
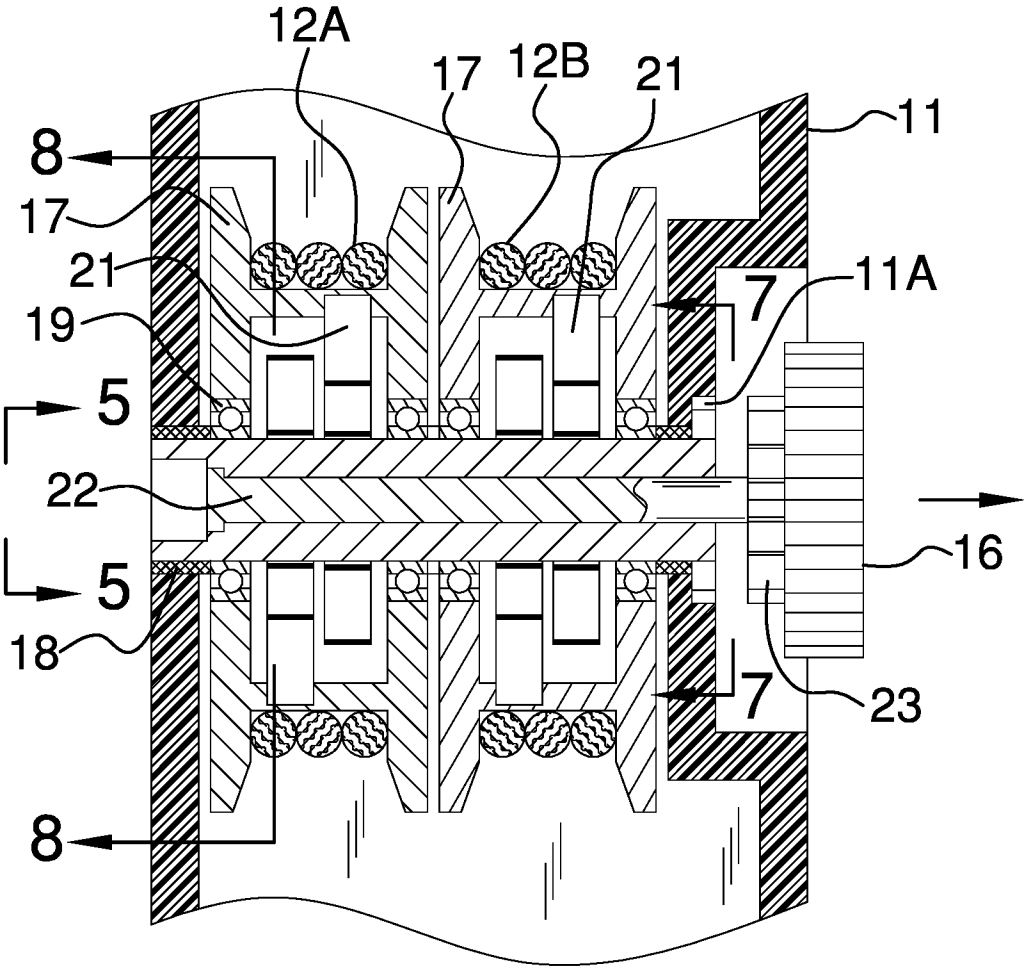
FIG. 4 illustrates a detailed cross-sectional view of the rotating spool along line 4-4 in FIG. 2.
Figure 5:
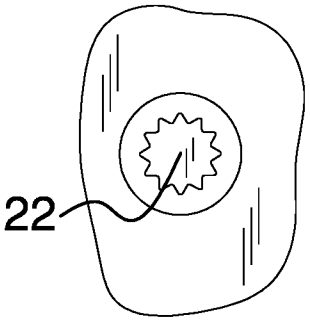
FIG. 5 illustrates a detailed view of the shaft lock.
Figure 6:
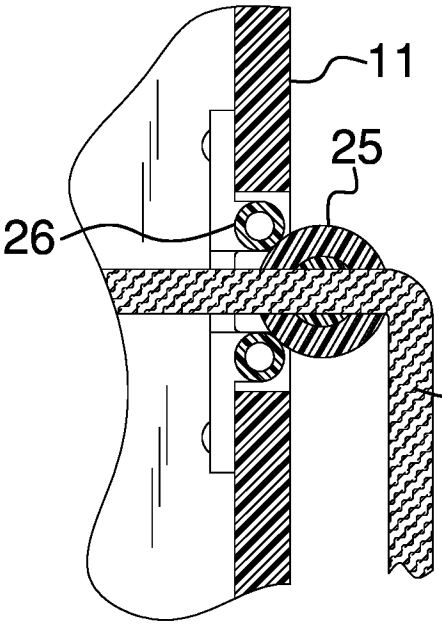
FIG. 6 illustrates a cross-sectional view of the invention, detailing one of the cables, a stop ball, and rollers mounted to the housing.
Figure 7:
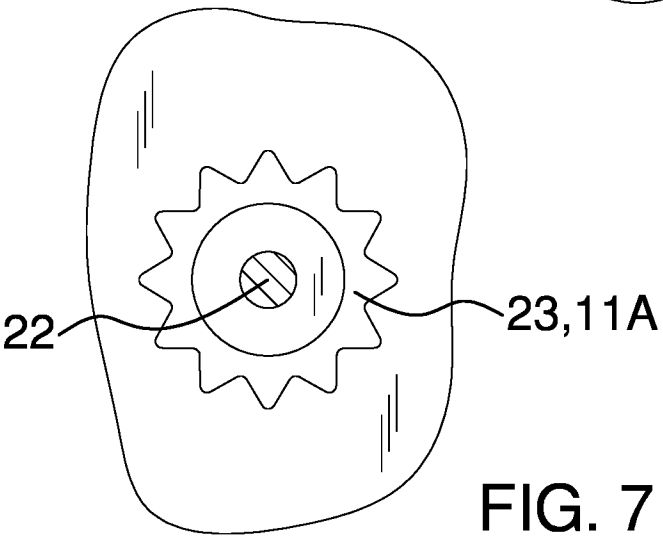
FIG. 7 illustrates a cross-sectional view of the invention long line 7-7 in FIG. 4 detailing the shape of the tensioning nob lock.
Figure 8:
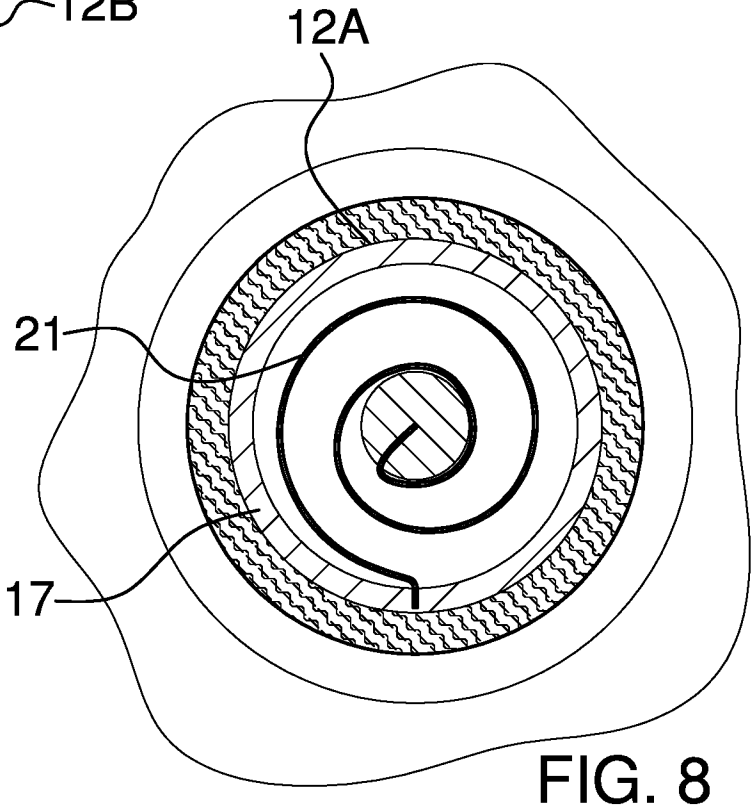
FIG. 8 illustrates a cross-sectional view of the invention long line 8-8 in FIG. 4 detailing the rotating spool, a spring oil spring, and band.
Figure 9:
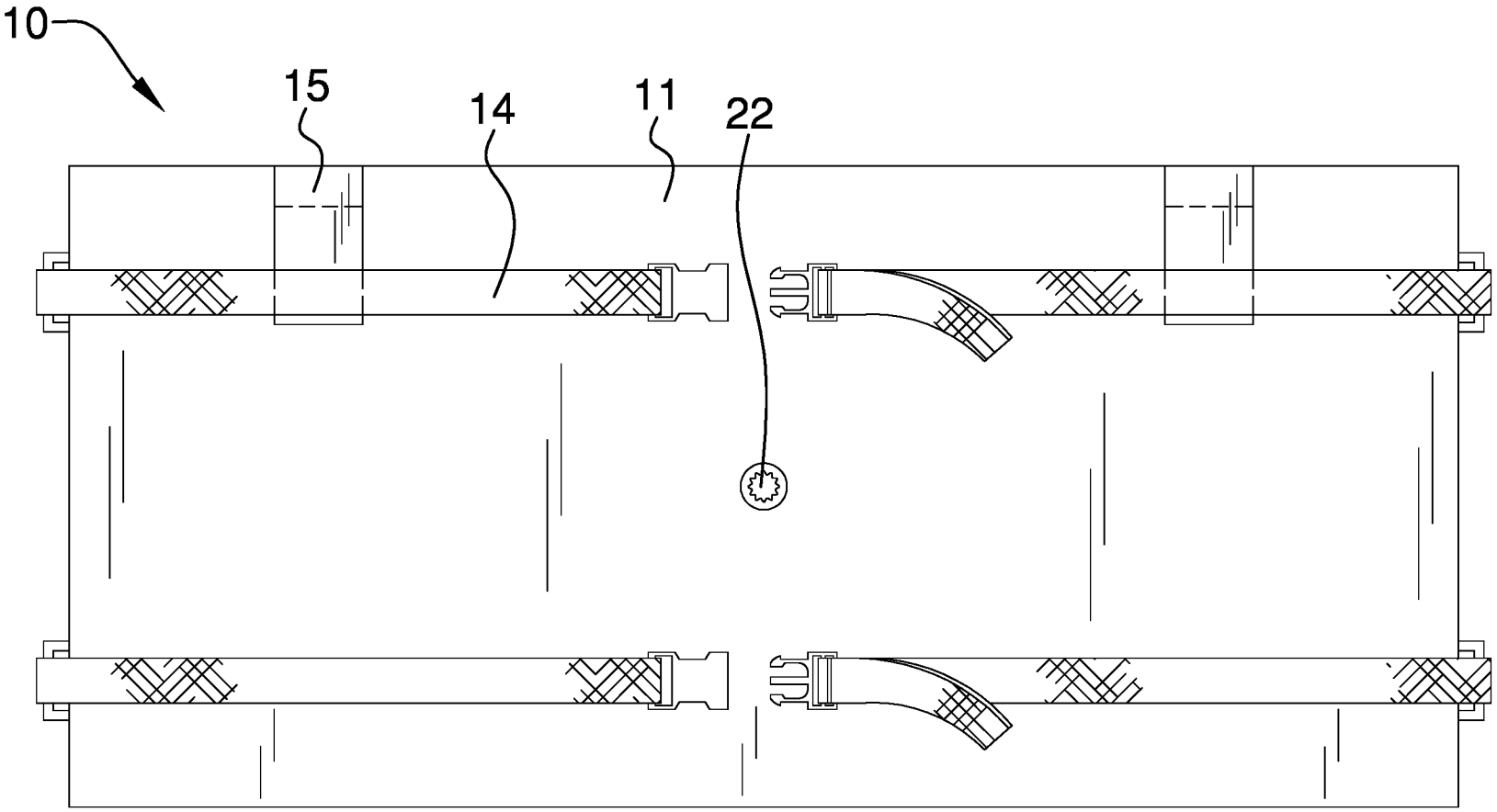
FIG. 9 illustrates a rear view of the housing and straps.
Figure 10:
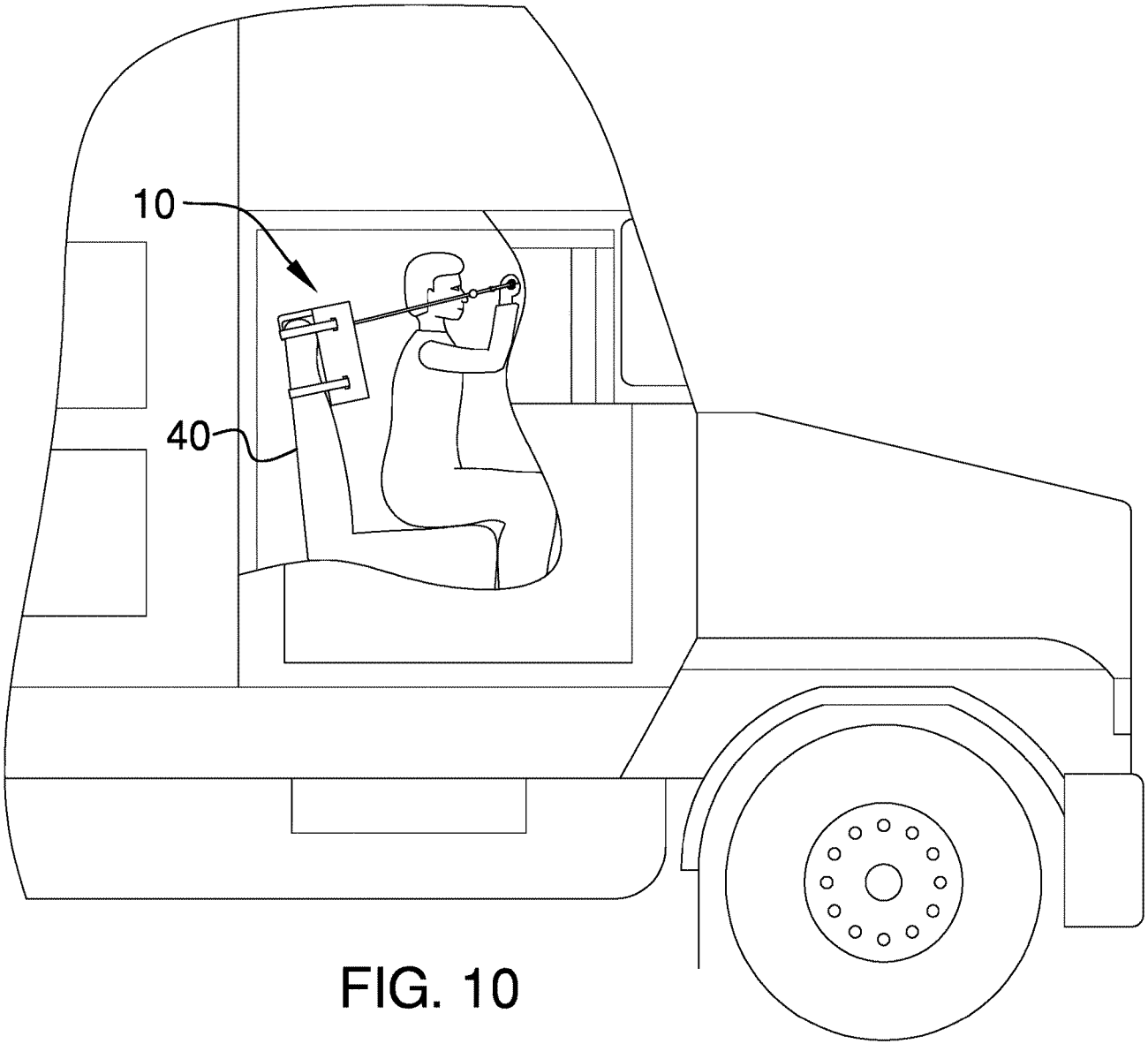
FIG. 10 illustrates a view of the invention in use in a vehicle.

Detailed reference will now be made to the preferred embodiment of the invention, examples of which are illustrated in FIGS. 1-10. A portable exercise device 10 (hereinafter invention) that mounts to a front surface of a seat back 40. The invention 10 includes a housing 11, a plurality of cables 12, a plurality of handles 13, a plurality of straps 14, a plurality of hooks 15, and a tensioning knob 16.

The invention 10 is designed to be installed upon a front surface of the seat back 40 via the plurality of straps 14 and the plurality of hooks 15. However, the invention 10 may secure the housing 11 to the seat back 30 via the use of either the straps 14 or the hooks 15.

Inside of the housing 11 is a plurality of rotating spools 17, which are secured in place via a plurality of bushings 18, and capable of rotational movement via a plurality of bearings 19 that are co-axially mounted between the rotating spools 17 and a tensioning shaft 20. The rotating spools 17 attach to the tensioning shaft 20 via a spiral spring coil 21. It shall be noted that the invention 10 depicts a rotating spool 17 for coiling a left cable 12A, and a second rotating spool 17 for coiling a right cable 12B.

The tensioning shaft 20 has a tensioning bar 22 that can move back and forth inside of the tensioning shaft 20 via internal threading. The tensioning bar 22 connects to a tension knob lock 23 and the tensioning knob 16. Upon tightening of the tensioning knob 16, the tensioning knob lock 23 will engage a shoulder 11A located on the exterior of the housing 11, which will act as a tensioning means upon the cables 12.

The invention 10 can be temporarily installed upon the front surface of the seat back 30, and the resistance on the cables 12 adjusted to the end user's preference. Then the end user shall pull upon the cables 12 via the handles 13 with either the use of his arms or legs in a plurality of muscle targeting exercises.

It should be noted that the length of the cables 12 shall be no less than three feet.

Each of the cables 12 has a stop ball 25 at a predetermined length from the handle 13, and of which enables a roller 26 that is mounted adjacent an opening 11A located on each side of the housing 11. The stop ball 25 prevents the handle 13 from engaging the side of the housing 11. The rollers 26 insure a smooth winding and unwinding of the cables 12 from the rotating spools 17, and also to prevent unwanted wear of the cables 12 associated with frictional generated between the cables 12 and the respective opening 11A of the housing 11.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A seat back mountable exercise device for use while seated comprising:

an attaching means;

a plurality of cables;

wherein each of the cables has a handle;

a tensioning means;

a plurality of rotating spools;

wherein each of the rotating spools wrap up a cable;

wherein the rotating spools attach to the tensioning means via a resistance means;

wherein the rotating spool can extend and retract the cable from within a housing; and wherein each of the cables exit the housing via an opening;

wherein the attaching means comprises a strap, a plurality of straps, a hook, or a plurality of hooks; wherein the attaching means secures the device to a front surface of the seat back, such that the exercise device is configured to be positioned between the front surface of the seat back and a back of a user.

2. The exercise device as described in claim 1 wherein the resistance means comprises a spiral coil spring that is connected between one of the rotating spools and the tensioning means.

3. The exercise device as described in claim 2 wherein the spiral coil spring imposes a biasing force that will wind up the cable upon the respective rotating spool when no force is exerted upon the handle or cable.

4. The exercise device as described in claim 2 wherein the tensioning means comprises a knob that when rotated applies a braking force upon both of the rotating spools such that the level of overall resistance when uncoiling the cables from their respective rotating spool will correspond to the level of braking force applied by the tensioning means.

5. The exercise device as described in claim 1 wherein the cable has an overall length no less than three feet.

6. The exercise device as described in claim 1 wherein the cables have a stop ball located at a predetermined length from the handle, which prevents the handle from contacting the outer surface of the housing.

7. The exercise device as described in claim 6 wherein a roller is mounted adjacent the opening of the housing, and insures smooth movement of the cable.

* * * * *